United States Patent [19]

Furutsu

[11] Patent Number: 4,923,106

[45] Date of Patent: May 8, 1990

[54] PISTON DRIVING APPARATUS IN TAG ATTACHER

[75] Inventor: Akira Furutsu, Tokyo, Japan

[73] Assignees: Japan Bano'k Co., Ltd., Tokyo, Japan; Ben Clements & Sons, Inc., South Hackensack, N.J.

[21] Appl. No.: 227,215

[22] Filed: Aug. 2, 1988

[30] Foreign Application Priority Data

Oct. 15, 1987 [JP] Japan ..... 62-156729

[51] Int. Cl.[5] ..... B65C 7/00

[52] U.S. Cl. ..... 227/67; 192/33 R

[58] Field of Search ..... 227/67, 120; 221/215, 221/258; 74/45; 192/33 R

[56] References Cited

U.S. PATENT DOCUMENTS

| | | | |
|---|---|---|---|
| 2,535,306 | 12/1950 | Mackey | 192/33 R |
| 2,547,475 | 4/1951 | Larsen | 192/33 R |
| 2,784,817 | 3/1957 | Lessman | 192/33 R |
| 2,860,749 | 11/1958 | Keltz | 192/33 R |
| 2,967,406 | 1/1961 | Buzicky | 192/33 R |
| 3,598,025 | 8/1971 | Cotton | 227/67 |
| 3,734,375 | 5/1973 | Bone et al. | 227/67 |

*Primary Examiner*—Rodney H. Bonck
*Assistant Examiner*—Scott Anchell
*Attorney, Agent, or Firm*—Blum Kaplan

[57] ABSTRACT

An apparatus for reciprocating a piston that drives a tag pin through a hollow needle. The apparatus comprises a crank for oscillating an oscillating arm that reciprocates the piston; a cam for stopping a crank rotating motor when the oscillating arm oscillated by the crank returns to the home position; and a lever for rotating the cam to the motor starting position.

4 Claims, 9 Drawing Sheets

PISTON DRIVING APPARATUS IN TAG ATTACHER

BACKGROUND OF THE INVENTION

This invention relates to a piston driving apparatus in tag attachers and more specifically to an improved motor-powered piston driving apparatus.

In recent years tags showing the quality and price of merchandise and attached to them use H-shaped tag pins formed of synthetic resin each of which consists of a transverse bar, a filament portion, and a head portion.

The tag pins are driven by the tag attacher. Manual tag attachers of conventional types require an operator to pull the trigger in such a manner as to overcome the force of a spring interposed between the tag attacher body and an intermediate lever. This construction will easily tire the operator.

With the conventional tag attachers, it is difficult to continue the tag attaching work for a long period of time. Moreover, with the elapse of time the work efficiency of an operator using the conventional manual tag attacher deteriorates.

To eliminate the abovementioned problems with the manual tag attacher, some improvements are being made to the conventional manual tag attacher to transform it into a motor-powered tag attacher. The motor-powered tag attachers, however, also have drawbacks. That is, with the motor-powered tag attacher, it is necessary to start, reverse and stop the electric motor to reciprocate the piston that drives the tags through and out of a hollow needle. When three switches for starting, reversing and stopping the motor and the associated electric circuits are built into the conventional manual tag attacher, the motor-powered tag attacher becomes costly because of the added electric parts and thus is not competitive in terms of price with the manual tag attacher. Furthermore, the use of switches for controlling the starting, stopping and reverse rotation of the motor will not only increase the chance of failure but reduce the durability. Another problem of the motor-powered tag attacher in which the reciprocating motion of the tag pin driving piston is sensed by the switch to control the rotation of the motor is that the operation is slow and not a match for the manual tag attacher in terms of operation speed.

SUMMARY OF THE INVENTION

The object of this invention is to provide a piston driving apparatus in tag attachers which is simple in construction, seldom fails, and is inexpensive as compared with the piston driving apparatus of the conventional motor-powered tag attacher and whose operation speed is comparable to or higher than that of the manual tag attacher.

The invention that achieves the above objective comprises: a crank for oscillating an oscillating arm that drives the piston; a cam which stops the crank rotating motor when the oscillating arm oscillated by the crank returns to the initial or home position; and a lever for rotating the cam to the motor starting position.

According to this invention, there is no need to provide a number of switches and the associated complicated electric circuits, as required with the conventional motor-powered tag attachers, so that the structure becomes simple reducing the possibility of failures and the cost of production.

Furthermore, since the tag pin driving piston is reciprocated by engaging the oscillating arm with the rotating crank, the returning speed of the piston becomes faster than the tag pin driving speed, assuring a highly efficient tag attaching work.

DESCRIPTION OF THE PREFERRED EMBODIMENTS

Now, we will explain in detail an embodiment of the invention by referring to the attached drawings.

Figure 1:
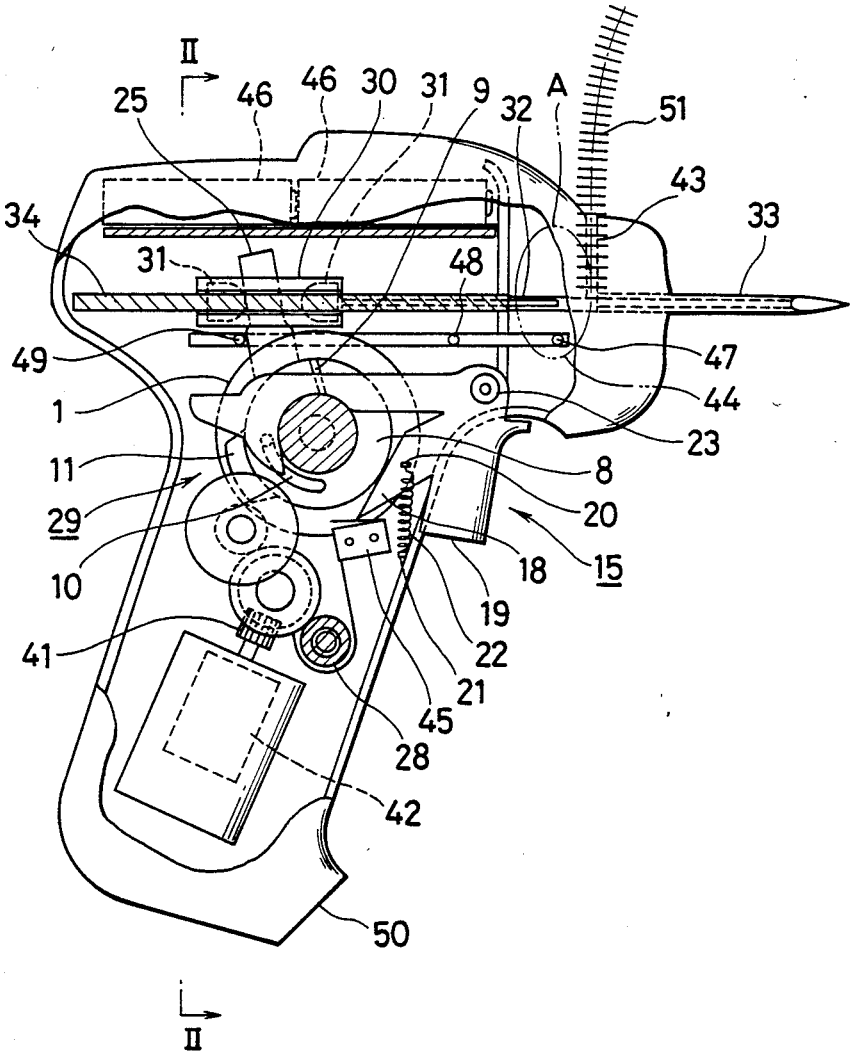
FIG. 1 is a partly cutaway side view of a tag attacher having a piston driving apparatus of this invention.
Figure 3:
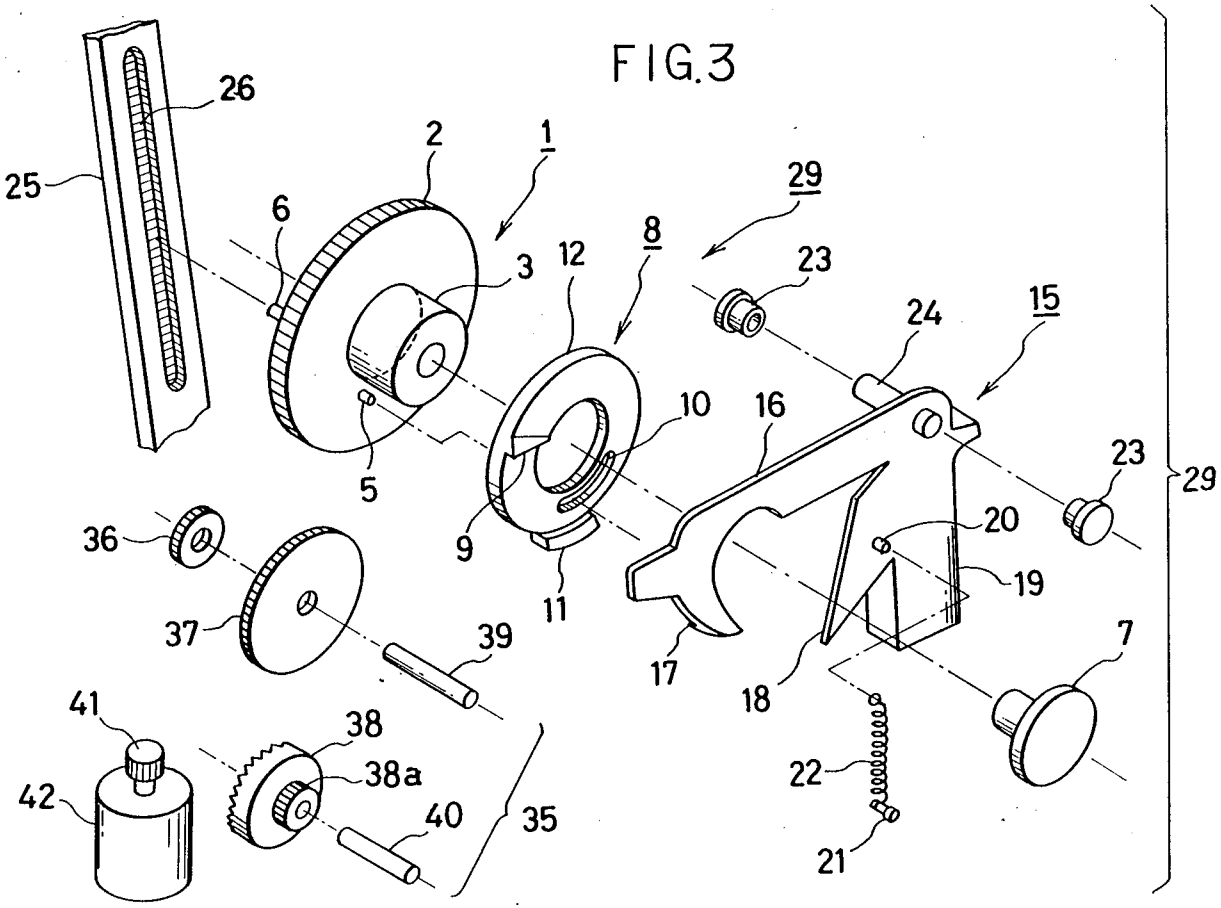
FIG. 3 an exploded perspective view of the piston driving apparatus.

As shown in FIG. 1, a body 50 of the tag attacher is almost T-shaped and has a piston driving apparatus 29 built therein. As shown in FIG. 3, the piston driving apparatus 29 consists of a crank 1, a cam 8 and a lever 15, each formed of synthetic resin. The crank 1 is driven by an electric motor 42.

The crank 1 consists of a gear disk 2, a shaft 3, a projection 5 and a crank pin 6. The gear disk 2 has at one side the crank pin 6 inserted in a groove 26 of an oscillating arm 25 and, at the other side, the projection 5 inserted in a slot 10 of the cam 8, which will be described later. The crank 1 is rotatably mounted on a support member 7 which is secured to the body 50.

The cam 8 is doughnut-shaped and rotated by the crank 1 or the lever 15 which will be described later. A doughnut plate 12, the main part of the cam 8, is fitted over the shaft 3 of the crank 1 and has in its edge surface an arc slot 10 through which the projection 5 of the crank 1 is inserted. At its edge surface the doughnut plate 12 has an engagement portion 9 with which a claw 17 of the lever 15 engages. The doughnut plate 12 also has on its circumferential surface a projection 11 that turns a switch 45 on and off. The slot 10 and the projection 11 are arranged in almost the same phase.

Figure 4:
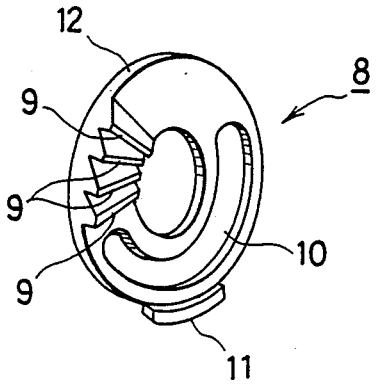
FIG. 4 is a perspective view of another example of the cam.

As shown in FIG. 4, the cam 8 may be provided with a plurality of engagement portions 9 to ensure reliable engagement with the claw 17 of the lever 15.

The lever 15 consists of an arm 16, a claw 17, a pressing portion 18, a trigger 19 and a shaft 24, and is oscillatably mounted, through the shaft 24, on a pair of support members 23 secured to the body 50. The arm 16 and the trigger 19 are arranged in the shape of a letter L with the pressing portion 18 disposed slantwise between them. As shown in FIG. 1, a spring 22 disposed between a pin 20 on the pressing portion 18 and a pin 21 on the body 50 urges the pressing portion 18 counterclockwise, pressing the switch 45 to cut off the current supply.

The arm 16 is curved at its front end along the edge surface of the cam 8. As shown in FIG. 3, the front end of the arm 16 is formed with the claw 17 that engages the engagement portion 9 of the cam 8. To ensure the engagement between the claw 17 and the engagement portion 9 of the cam 8, the arm 16 has some degree of resiliency in the direction perpendicular to its end surface.

The pressing portion 18 is for turning the switch 45 on or off. When the trigger 19 is pulled, the pressing portion 18 parts from the switch 45, turning it on. When the trigger 19 is released, the spring 22 causes the lever 15 to press the switch 45, turning it off.

Figure 2:
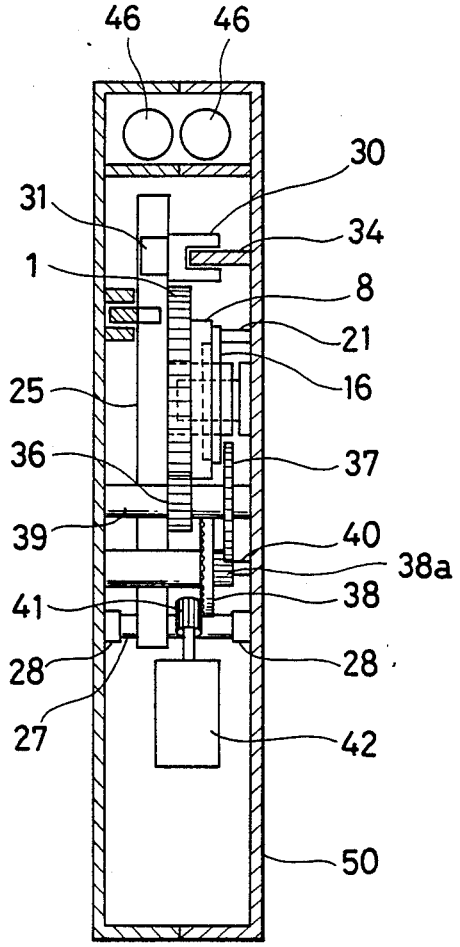
FIG. 2 a cross section taken along the line II—II of FIG. 1.

Referring to FIG. 2, the oscillating arm 25 has a shaft 27 at its lower part through which it is mounted oscillatably on a pair of bearings 28 secured to the body 50. In FIG. 3, the oscillating arm 25 has at its side surface a guide groove 26 in which the crank pin 6 provided to the gear disk 2 is inserted. The crank pin 6, as shown in FIG. 7*a*, moves in circle as the gear disk 2 rotates. The oscillating arm 25 thus moves about the shaft 27 in the longitudinal direction of the body 50 and quickly returns to the home position.

As shown in FIG. 2, a slider 30 is slidably mounted on a rail 34 secured to the body 50. In FIG. 1, the slider 30 has two projections 31, 31, between which the upper part of the oscillating arm 25 is disposed. At the front end of the slider 30 is secured a tag pin pushing piston 32 which pushes the transverse bar of the tag pin positioned in front of a hollow needle 33 when the slider 30 advances forward along the rail 34 of the body 50. And a cutter not shown cuts the connecting portion between the transverse bar of the tag pin and the base bar of a tag pin assembly 51. Then, as the transverse bar of the tag pin is pushed by the piston 32, it passes through the hollow needle 33 out into the back of the merchandise.

In FIG. 3, a reduction gear 35 consists of gears 36, 37 both secured to a shaft 39, a crown gear 38 mounted on a shaft 40, and a gear 38*a* integrally secured to the crown gear 38. The gear 36 is in mesh with the gear disk 2 of the crank 1; the gear 37 is in mesh with the gear 38*a;* and the crown gear 38 is in mesh with a pinion 41 mounted on the shaft of the motor 42. The motor 42 is powered by a battery 46 accommodated in the body 50 or by dc current supplied from outside the body 50. The motor 42 is started and stopped by the switch 45.

At location A facing the guide groove 43 in which the tag pin assembly 51 is inserted, a feeding means 52 and a backtracking prevention means 53, both with known constructions, are installed. The feeding means 52 feeds the transverse bar of the lowermost tag pin of the tag pin assembly 51 to the front of the hollow needle 33. The feeding means 52 is oscillated by a slide bar 44 which is reciprocated in the front and back directions of the body 50 by the oscillating arm 25.

Figure 5:
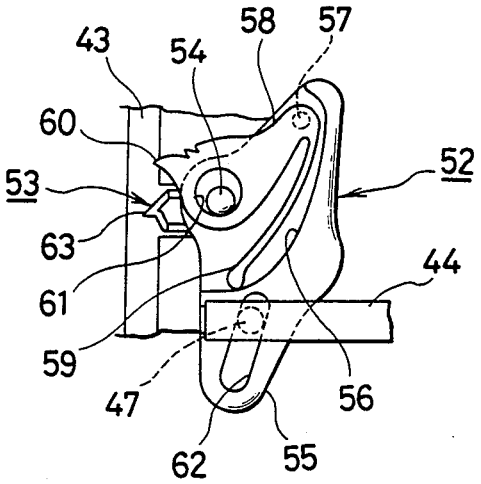
FIG. 5 is a side view of a feeding means and a backtracking prevention means.

As shown in FIG. 5, the feeding means 52 consists of a support plate 55 oscillatably mounted on the body 50 through a pin 54 and a feeding piece 58 mounted on a recessed portion 56 of the support plate 55 through a pin 57. The feeding piece 58 has a spring member 59 which urges a claw 60 of the feeding piece 58 to project from the support plate 55. The amount of projection of the claw 60 is restricted by a hole 61. A connecting portion 47 of the slide bar 44 engages a slit 62 formed in the support plate 55. The slide bar 44 has at its side two projections 48, 49 with which the oscillating arm 25 comes into contact.

The backtracking prevention means 53 is provided to the feeding means 52 in a direction crossing the guide groove 43, with its claw 63 holding the connecting portion of the tag pin assembly 51. The claw 63 is urged by a spring not shown to project into the guide groove 43.

The action of the piston driving apparatus with the above construction will be explained by referring to FIGS. 6 to 10.

Figure 6:
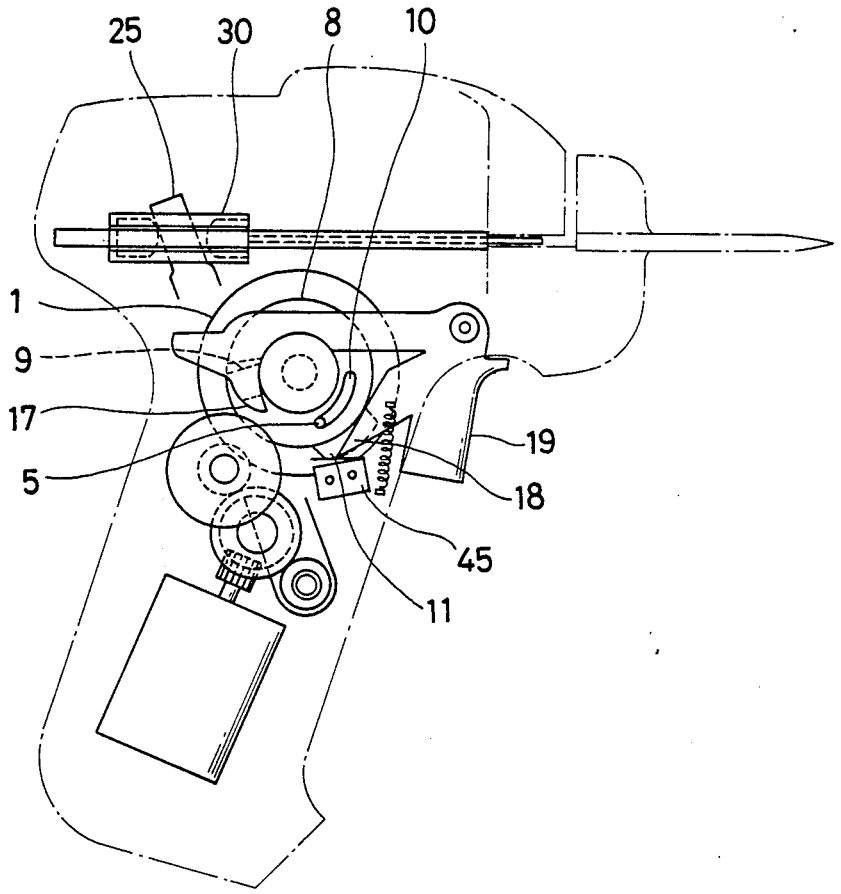
FIGS. 6, 7, 7*a* and 8 to 10 are explanatory drawings showing the action of the tag attacher.

(a) FIG. 6 shows the tag attacher with the trigger 19 not pulled and with the oscillating arm 25 located at the home position. In this state, the switch 45 is pressed by the pressing portion 18 and turned off.

Figure 7:
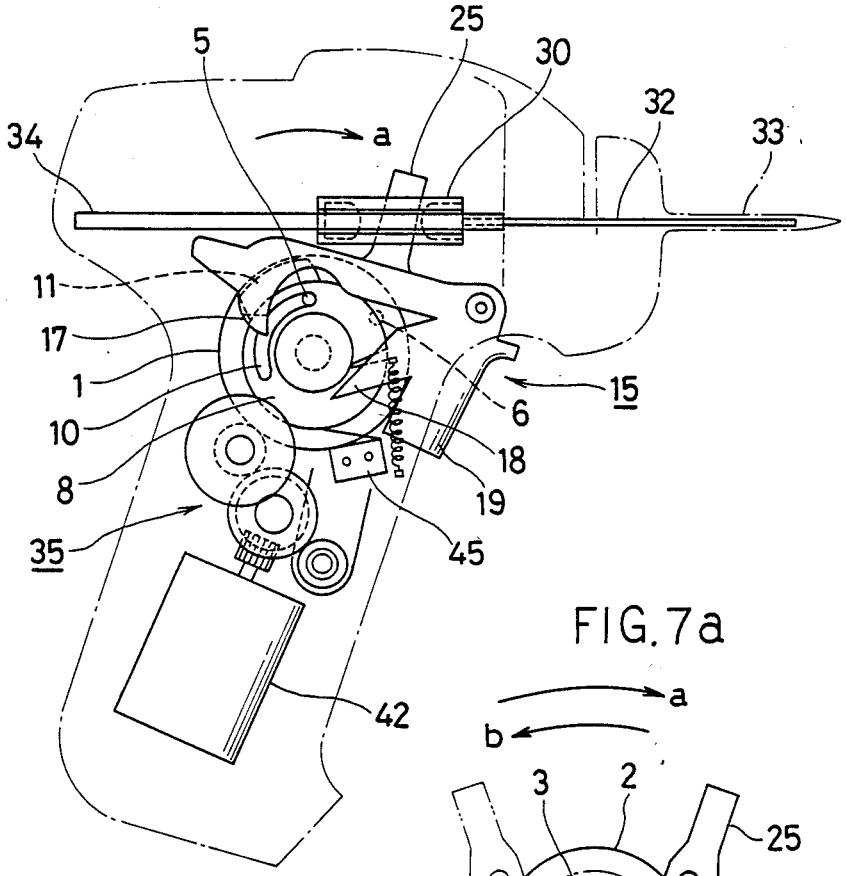
Figure 7A:
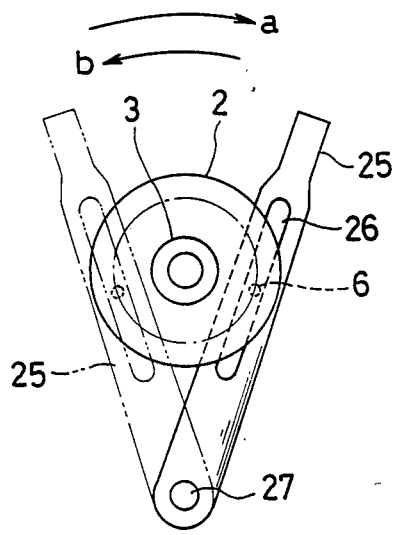

(b) Next, when the trigger 19 is pulled as shown in FIG. 7, the pressing portion 18 parts from the switch 45 turning it on and starting the electric motor 42. The rotation of the motor 42 is transmitted through the reduction gear 35 to the crank 1, which is then rotated clockwise oscillating the oscillating arm 25 as indicated by the arrow a. The piston 32 is pushed in the same direction driving the tag pin positioned at the front of the hollow needle 33 through and out of the hollow needle 33.

Then, as shown in FIG. 7*a*, after the guide groove 26 of the oscillating arm 25 lies tangent to the circular locus of the guide pin 6, the oscillating arm 25 starts returning in the direction of the arrow b.

Since the projection 5 of the crank 1 is in contact with one end of the slot 10 of the cam 8, the rotation of the crank 1 causes the cam 8 to rotate.

Figure 8:
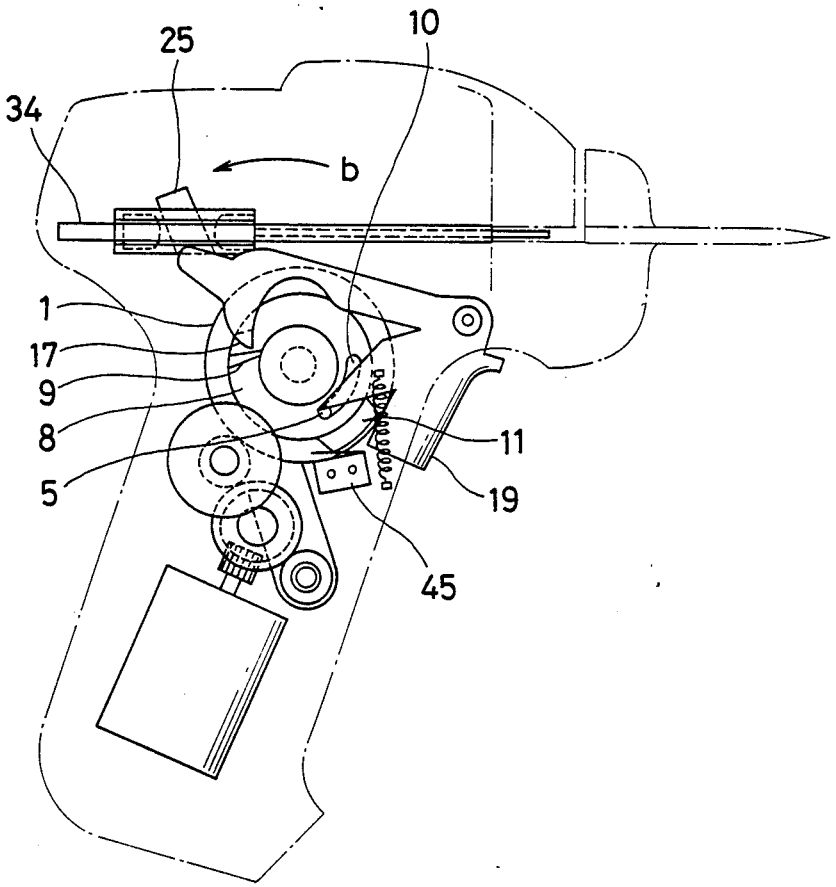

(c) And, as shown in FIG. 8, when the oscillating arm 25 has returned to the home position, the projection 11 of the cam 8 presses the switch 45 turning it off and bringing the oscillating arm 25 to a halt at the home position.

Figure 9:
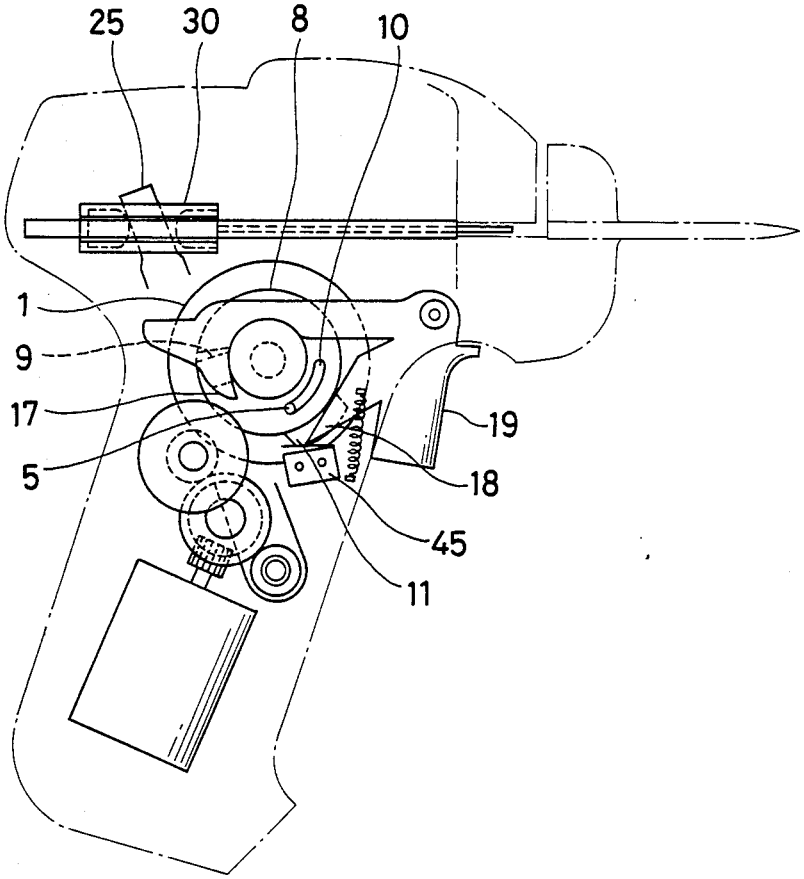

(d) When in this state the trigger 19 is released, the pressing portion 18 of the lever 15 presses the switch 45. As shown in FIG. 9, the switch 45 is now depressed by two members, i.e., the projection 11 of the cam 8 and the pressing portion 18 of the lever 15.

Under this condition, the positional relationship between the engagement portion 9 of the cam 8 and the claw 17 of the lever 15 is as shown in FIG. 9 in which the claw 17 is located below the engagement portion 9.

Figure 10:
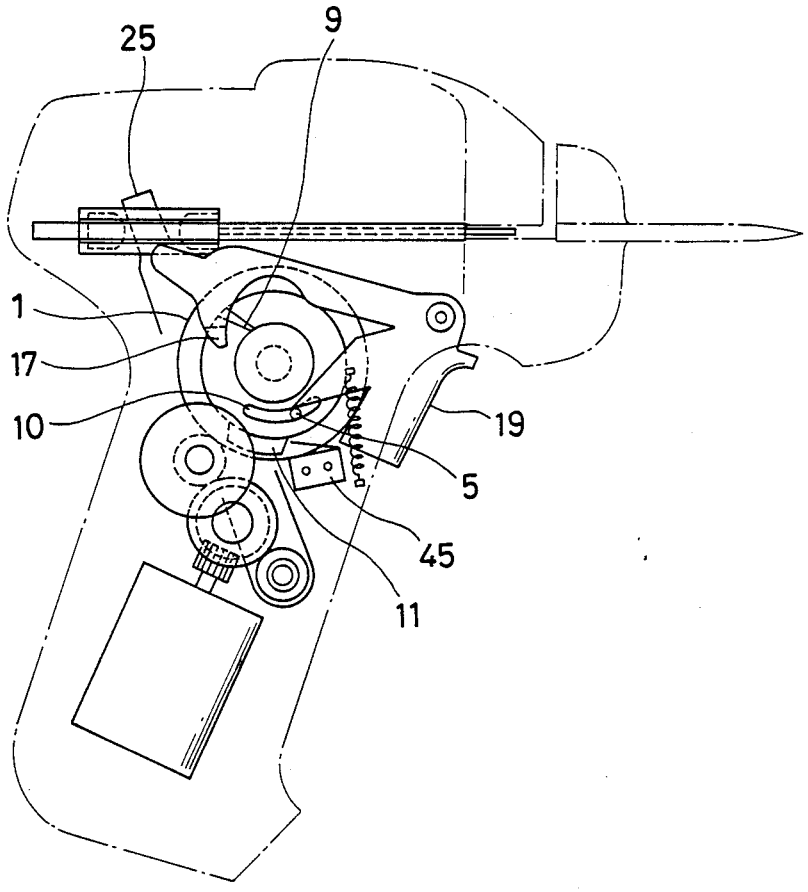

(e) When as shown in FIG. 10 the trigger 19 is pulled again, the claw 17 of the arm 16 engages the engagement portion 9 of the cam 8, rotating the cam 8 clockwise.

When the projection 11 of the ca 8 parts from the switch 45, the switch 45 is turned on, starting the motor 42 again. Then the oscillating arm 25 again performs one cycle of reciprocating motion until it returns to the home position as shown in FIG. 8.

In this way, pulling the trigger 19 repetitively forces a series of the tag pins out of the tag attacher.

The range in which the cam 8 is rotated by the claw 17 of the lever 15 must be large enough to allow the projection 11 pressing the switch 45 to rotate clockwise over the switch 45 and disengage from it. The length of the slot 10 of the cam 8 is set slightly longer than the distance which is required to allow the projection 11 of the cam 8 to rotate pressing the switch 45 and disengage from it. Provision of such a play to the slot 10 ensures smooth stopping and starting of the motor 42.

The projection 5 of the crank 1 is inserted in the slot 10 of the cam 8 with the abovementioned length, so that when the cam 8 is rotated by the claw 17 of the lever 15 which engages the engagement portion 9 of the cam 8, i.e., while the projection 11 of the cam 8 is rotated pressing the switch 45 until it disengages from the switch 45, the crank 1 remains at rest.

I claim:

1. A piston driving apparatus for use in a tag attacher having a piston displaceable between a home position and an actuating position, comprising an oscillating arm coupleable to said piston for displacing said piston between its home and actuating positions, a crank coupled to said oscillating arm for displacing said oscillating arm to operate said piston, motor means coupled to said crank for actuating said crank to displace said oscillating arm, a cam coupled to said crank for selectively deactuating said motor means when said oscillating arm returns said piston to its home position, and a lever coupleable to said cam for displacing said cam to permit actuation of said motor means.

2. The piston driving apparatus as claimed in claim 1, wherein said crank includes a gear disk having first and second sides, a crank pin supported on said first side of said gear disk, said oscillating arm having a groove, said crank pin being inserted in said groove, said second side of said gear disk having a shaft portion and a projection, said cam having a slot and being supported on said shaft portion, said projection being received in said slot.

3. The piston driving apparatus as claimed in claim 2, wherein said cam includes a doughnut-shaped plate supported on said shaft portion of said gear disk, said plate having an end surface and a circumferential portion, an arc slot formed on said end surface of said plate, said projection being inserted in said arc slot, said plate having an engagement portion formed on the end surface thereof, said lever having a claw in selective engagement with said engagement portion of said plate, and a second projection provided on the circumferential portion of said plate for selectively deactuating said motor means.

4. The piston driving apparatus as claimed in claim 3, wherein said lever includes an arm and a trigger arranged in an L-shaped configuration and a pressing portion disposed therebetween, said arm having a tip, said claw being formed at the tip of said arm, said motor means having switch means for turning said motor means on and off, and spring means disposed intermediate said pressing portion and said tag attacher for normally pressing said pressing portion against said switch means to turn off said motor means.

* * * * *